US008910746B1

(12) United States Patent
McKenzie

(10) Patent No.: US 8,910,746 B1
(45) Date of Patent: Dec. 16, 2014

(54) FIREARM SUPPRESSOR

(71) Applicant: Thomas McKenzie, Anaheim Hills, CA (US)

(72) Inventor: Thomas McKenzie, Anaheim Hills, CA (US)

( * ) Notice: Subject to any disclaimer, the term of this patent is extended or adjusted under 35 U.S.C. 154(b) by 0 days.

(21) Appl. No.: 14/467,216

(22) Filed: Aug. 25, 2014

(51) Int. Cl.
*F41A 21/00* (2006.01)
*F41A 21/30* (2006.01)

(52) U.S. Cl.
CPC ..... *F41A 21/30* (2013.01)
USPC ..... 181/223

(58) Field of Classification Search
USPC ..... 181/223
See application file for complete search history.

(56) References Cited

U.S. PATENT DOCUMENTS

| | | | | |
|---|---|---|---|---|
| 1,017,003 | A | 2/1912 | Kenney | |
| 1,111,202 | A | 9/1914 | Westfall | |
| 3,385,164 | A | 5/1966 | Karl-Heinz Walther et al. | |
| 3,478,841 | A | 11/1969 | Hubner | |
| 5,029,512 | A * | 7/1991 | Latka | 89/14.4 |
| 5,559,302 | A | 9/1996 | Latka | |
| 7,594,464 | B2 | 9/2009 | Dueck | |
| 8,286,750 | B1 * | 10/2012 | Oliver | 181/223 |
| 8,511,425 | B2 | 8/2013 | Larue | |
| 8,567,556 | B2 * | 10/2013 | Dueck et al. | 181/223 |
| 8,579,075 | B2 * | 11/2013 | Brittingham et al. | 181/223 |
| 8,739,922 | B2 * | 6/2014 | Wirth et al. | 181/223 |
| 2012/0103176 | A1 | 5/2012 | Latka | |
| 2012/0152649 | A1 * | 6/2012 | Larue | 181/223 |
| 2012/0180624 | A1 | 7/2012 | Troy et al. | |
| 2012/0272818 | A1 | 11/2012 | Dueck et al. | |
| 2012/0273297 | A1 * | 11/2012 | Schlosser | 181/213 |

* cited by examiner

*Primary Examiner* — Forrest M Phillips
(74) *Attorney, Agent, or Firm* — Kenneth L. Green

(57) ABSTRACT

A suppressor includes baffles with geometry and spacing minimizing sound level in the human hearing range, and overlapping tapers on consecutive elements replacing welds. The geometry includes conical baffles with approach angles between 153.7 and 163.7 degrees and at least one inch separation. The suppressor is assembled by compressing the elements between threaded end caps, thus expending the overlapping tappers against the interior of a suppressor tube to center and align the baffles. The suppressor may be attached to a rifle using a quick disconnect mount which includes an adapter fixed to the rifle barrel and having an "L" shaped slot with a first leg parallel to the barrel and a second leg turned greater than 90 degrees towards the front of the adapter. A post in the suppressor engaged the slot and a spring biases the suppressor forward and holds the post at the end of the turned leg.

18 Claims, 10 Drawing Sheets

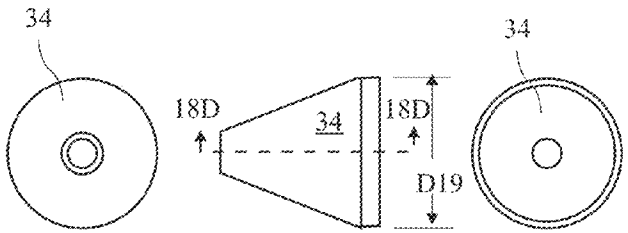
FIG. 18C
FIG. 18A
FIG. 18B
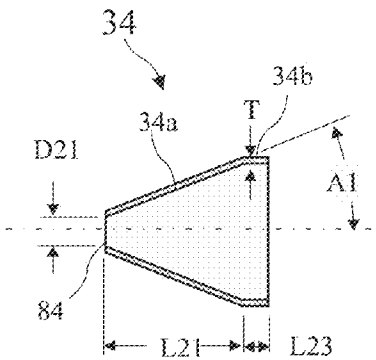
FIG. 18D
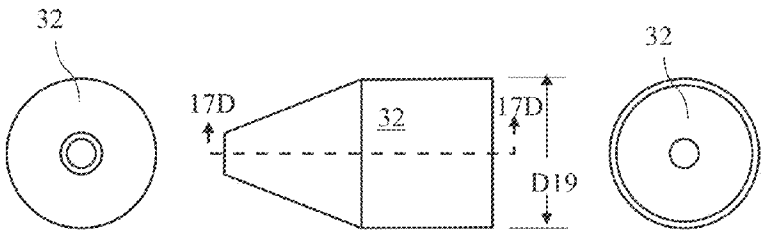
FIG. 17C
FIG. 17A
FIG. 17B
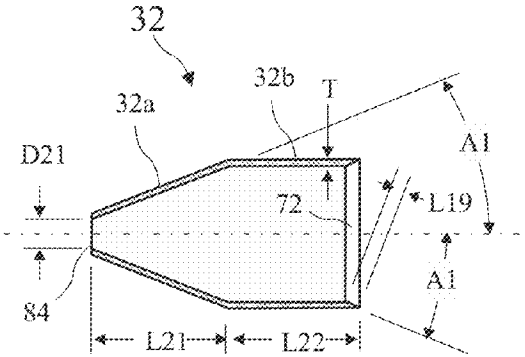
FIG. 17D

FIREARM SUPPRESSOR

BACKGROUND OF THE INVENTION

The present invention relates firearm sound suppressors and in particular to a suppressor for automatic weapons.

Firearms are often used in situations where the very loud sounds resulting from firing the weapons may both give away the position of the shooter or, especially indoors, temporarily deafen the shooter and others nearby. In a combat situation, giving away a shooters position may result in receiving hostile fire. Even temporary deafening may prevent communication between team members and prevent the shooter from hearing danger signs.

Many known suppressors are available, but suffer from various deficiencies. Many do not reduce sound levels sufficiently.

When used on automatic weapons, suppressor temperature may build quickly. Bullets are commonly constructed of jacketed lead. The lead softens quickly with temperature and melts at 621 degrees Fahrenheit which is a problem in known suppressors made of stainless steel and other materials which hold the heat inside the suppressor creating an oven like environment for the bullets to pass through. Lead melting temperature can be attained on known suppressors after as few as 60 rounds are fired in a full auto burst. This high temperature causes the lead to deform resulting in destabilizing the bullets as they pass through the suppressor causing baffle strikes and catastrophic failures.

BRIEF SUMMARY OF THE INVENTION

The present invention addresses the above and other needs by providing a suppressor which includes baffles with geometry and spacing optimized to minimize sound level in the human hearing range and overlapping tapers on consecutive elements replacing welds. The geometry includes conical baffles with approach angles between 153.7 degrees and 163.7 degrees and at least one inch separation. The suppressor is assembled by compressing the elements between threaded end caps, thus expending the overlapping tappers against the interior of a suppressor tube to center and align the baffles. The suppressor may be attached to a rifle using a quick disconnect mount. The quick disconnect mount includes an adapter fixed to the rifle barrel and having an "L" shaped slot with a first leg parallel to the barrel and a second leg turned greater than 90 degrees towards the front of the adapter. A post in the suppressor engaged the slot and a spring biases the suppressor forward and holds the post at the end of the turned leg.

In accordance with another aspect of the invention, there is provided a firearm suppressor reducing sound level in the human hearing frequency range. The suppressor includes a minimum of three tapered baffles having tapered cones pointing towards the barrel and having interior angles of between 16.3 degrees and 26.3 degrees, and preferably about 21.3 degree, which present an approach angle of between 153.7 degrees and 163.7 degrees, and preferably about 158.7 degrees, to sound waves. The approach angle combined with a separation between consecutive cones of at least one inch, and preferably about 1.25 inches, creates an acoustical dampening which attenuates the sound waves when a supersonic rifle bullet is fired. The combination of separation and approach angle causes the sound waves to reflect back upon each other as they travel outward along the taper to the outer edge of the taper, and then reflect inward, cancelling following sound waves and creating a quieter report in the human frequency range. Although the sound pressure level (measured in dB) is within 0.2 dB of a comparable suppressor, the perceived sound level is approximately 4 dB quieter in the human frequency range compared to known suppressors. Experiments have shown that the approach angle between 153.7 degrees and 163.7 degrees provides good results in the human frequency range.

In accordance with another aspect of the invention, there is provided an automatic rifle suppressor design including pressed together overlapping tapered surfaces between consecutive baffles. The overlapping surfaces replace welds used in suppressor designs. The baffles in the baffle stack meet at the cooperating tapered surfaces and form seals as the tapers are pressed together by tightening end caps. As the end cap is tightened, the tapers wedge together on consecutive baffles as female tapers are pushed into male tapers forming expanded rings pressing against an outer suppressor tube creating a seal and holding the baffles parallel and aligned preventing any loss of accuracy. Cylindrical portions of the baffles overlap with the outer suppressor tube to form a double wall which allows the suppressor to withstand pressure which can reach 15,000 Pounds per Square Inch (PSI) during sustained full auto fire. The use of overlapping tapers avoids distortions caused by the heat of welding as well as additional machining processes required to correct for welding distortion, and eliminates the risk of welds cracking and overall failure due to rupturing. The overlapping tapers also expand and contract with heat and retain their ability to seal under numerous heat cycles unlike welds which will only survive a number of heat cycles before failing. The overlapping tapers also reduce assembly time for production and allow the suppressor to be disassembled so it can be cleaned and inspected.

In accordance with yet another aspect of the invention, there is provided an automatic rifle suppressor design which eliminates the need for ports between baffle chambers present in known suppressors. A small bullet passage combined with an approach angle between 153.7 degrees and 163.7 degrees, and baffle spacing of at least one inch, and preferably about 1.25 inches, causes the gasses to immediately expand into a first chamber, then compress back through a small bullet passage of the first baffle. After compressing through the first bullet passage, the gasses immediately expand into the reverse side of the baffle into the next chamber. Once expanded into the second chamber, the gasses must once again condense back through the bullet passage and the process is repeated through a minimum of four chambers. The tapered design relies on the fact the gas flow re-circulates upon itself causing more time for it to expand and compress in order to exit the suppressor therefore reducing the sound report. The suppressor does not rely on ported muzzle devices in order to function correctly such as known rifle suppressors.

In accordance with another aspect of the invention, there is provided an automatic rifle suppressor preferably made of titanium to reduce overall weight. Even slight weight at the end of the barrel produces some barrel deflection. Using light weight titanium reduces the barrel deflection. Because of the reduced weight, only slight barrel deflection takes place, and the diameter of the bullet passage for a 0.224 inch diameter bullet may be as small as a 0.265 inches diameter through the baffles, and 0.281 inches diameter in the end cap. A preferred titanium is 6-4 titanium.

In accordance with yet another aspect of the invention, there is provided an automatic rifle suppressor design reducing suppressor temperature during automatic fire. Baffles, a blast baffle spacer, and outer suppressor tube have between 0.080 inches and 0.045 inches wall thicknesses and are overlapped to disperse heat very quickly and not retain heat as known suppressors do. The heat quickly disperses through the suppressor material and hot gasses in the suppressor are drawn out of the suppressor by the high velocity exhaust gasses of the supersonic rifle bullets exiting the suppressor. The suppressor operates approximately 150 to 200 degrees Fahrenheit cooler than other suppressors on the market and has yet to reach any temperature close to the 600 degrees Fahrenheit lead melting temperature even under sustained full auto fire. The outer suppressor tube of the suppressor also acts as a heat sink and will draw heat away from the inner baffles stacks allowing the suppressor to dissipate heat through the large cylindrical surface area of the outer suppressor tube which is exposed to outside air flow to assist with cooling.

In accordance with another aspect of the invention, there is provided a rifle suppressor which may be directly threaded onto the end of rifle barrels or attached using a quick disconnect mount. A muzzle adapter is attached to a forward end of the rifle barrel, preferably by threads. The adapter includes a slot having a first leg on a round exterior of the adapter reaching back from the front of the adapter parallel to the barrel bore, and a second leg tuned over 90 degrees, and winding around the exterior of the adapter. The quick disconnect mount includes a post on an interior round surface. The quick disconnect mount slides axially over the round exterior of the adapter and the post engages the slot. When the post reaches the turn in the slot, the quick disconnect mount is rotated and slides slightly forward. A spring biased slider in the quick disconnect mount presses axially against the adapter, thus biasing the suppressor forward creating a locking mechanism which is not overcome by normal operation or abuse that suppressors commonly see during their use. If direct rearward force is applied to the suppressor, it will remain in the locked position due to spring pushing the quick disconnect mount forward back into the locked position. The quick disconnect mount is detached from the adapter by applying rearward force and at the same time rotating the quick disconnect mount to align the post with the first leg. The first leg of the slot is preferably positioned at 12 o'clock.

In accordance with still another aspect of the invention, there is provided a quick disconnect mount including an internal slider which is spring loaded against the quick disconnect mount attached into the end of the barrel. The slider has a tapered face which axially mates against a corresponding tapered face on the muzzle adaptor. The cooperation of the tapered faces creating a seal so little or no gas pressure escapes in the rearward direction during firing.

In accordance with still another aspect of the invention, there is provided a quick disconnect mount including a spring retainer sleeve having a cylindrical interior which the inner sleeve rides on during the axial movement when the suppressor is installed and removed from the rifle. The spring retainer sleeve is exposed to expelled gasses and carbon build up when the rifle is fired. To avoid the carbon build up and possible failures, the spring retainer sleeve includes a sharp tapered surface which scrapes the outside surface of the slider each time the suppressor is removed, removing the carbon build up. This feature provides a self-cleaning quick disconnect mount and prevents a carbon buildup with known suppressors which make removal of the known suppressor difficult.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 17A is a side view of a first baffle according to the present invention.

FIG. 17B is a rear view of the first baffle according to the present invention.

FIG. 17C is a front view of the first baffle according to the present invention.

FIG. 17D is a cross-sectional view of the first baffle according to the present invention taken along line 17D-17D of FIG. 17A.

FIG. 18A is a side view of a second baffle according to the present invention.

FIG. 18B is a rear view of the second baffle according to the present invention.

FIG. 18C is a front view of the second baffle according to the present invention.

FIG. 18D is a cross-sectional view of the second baffle according to the present invention taken along line 18D-18D of FIG. 18A.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

In the following description, forward is in the direction of fire of the rifle and rearward is towards the rifle butt.

Figure 1A:
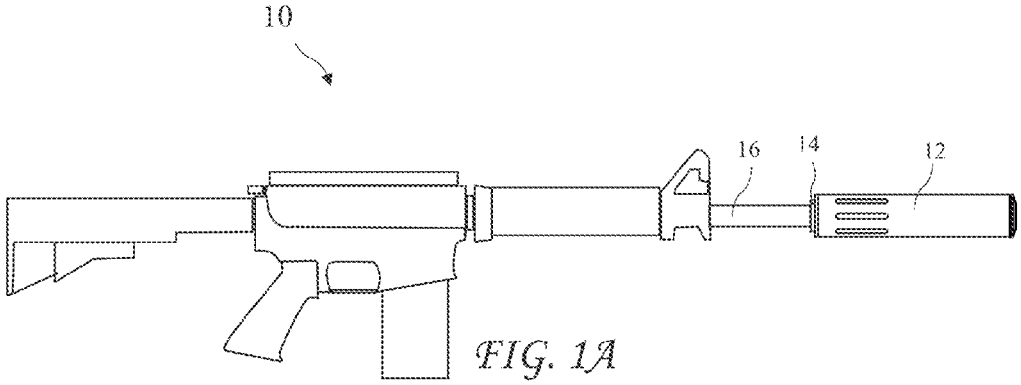
FIG. 1A is a side view of a rifle and suppressor according to the present invention.
Figure 1B:
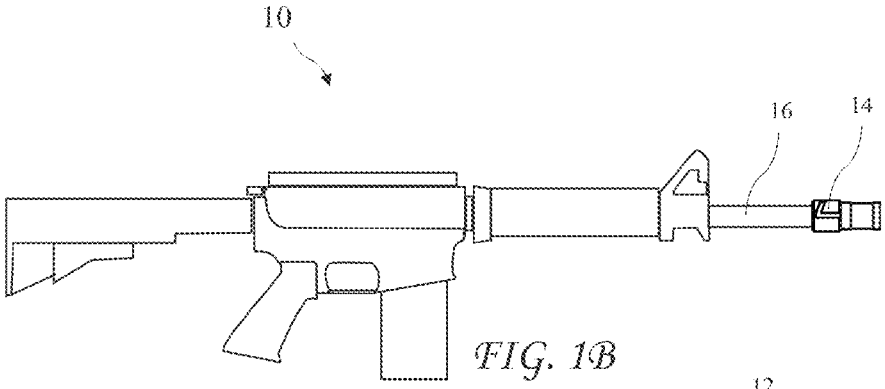
FIG. 1B is a side view of the rifle with the suppressor removed and showing a muzzle adapter for the suppressor according to the present invention.
Figure 2:
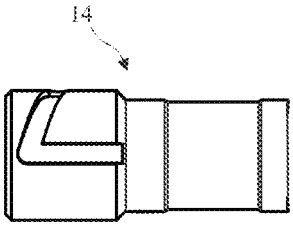
FIG. 2 is a side view of the muzzle adapter according to the present invention.
Figure 3:
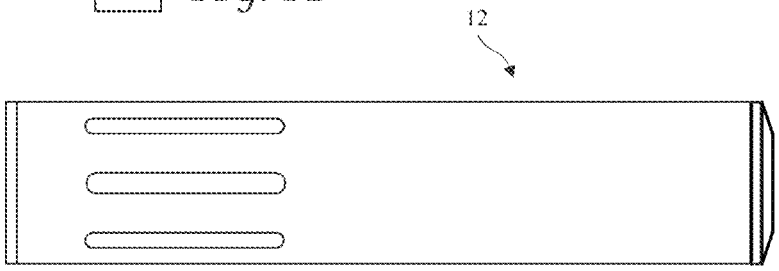
FIG. 3 is a side view of the suppressor according to the present invention.

A side view of a rifle 10 and suppressor 12 according to the present invention is shown in FIG. 1, a side view of the rifle 10 with the suppressor 12 removed and showing a muzzle adapter 14 for the suppressor 12 is shown in FIG. 1B, a side view of the muzzle adapter 14 alone is shown in FIG. 2, and a side view of the suppressor 12 alone is shown in FIG. 3. The suppressor 12 is attached to the muzzle adapter 14 by a quick disconnect mount 14.

Figure 4:
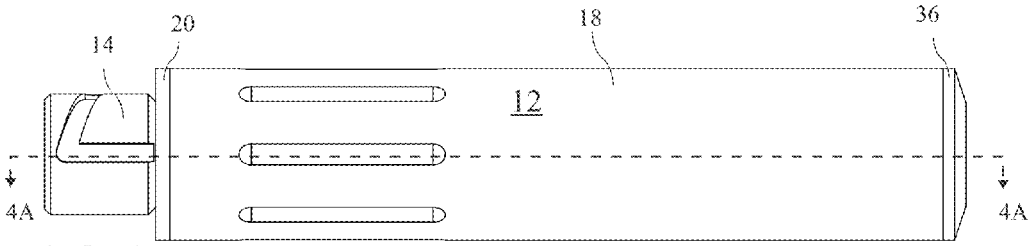
FIG. 4 is a side view of the suppressor partially attached to the muzzle adapter, according to the present invention.
Figure 4A:
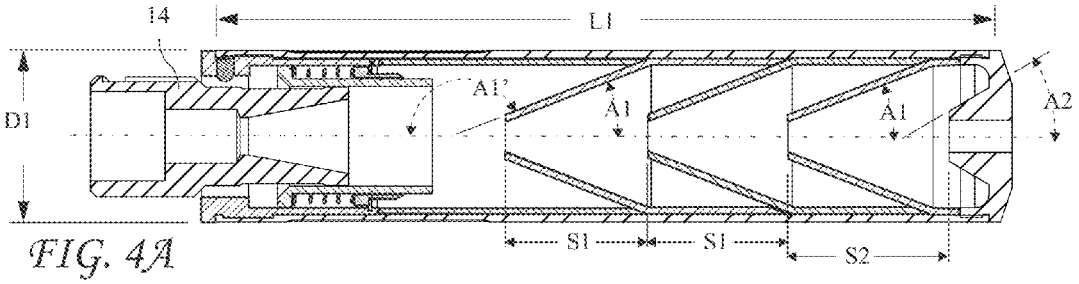
FIG. 4A is a cross-sectional view of the suppressor partially attached to the muzzle adapter according to the present invention, taken along line 4A-4A of FIG. 4.
Figure 5:
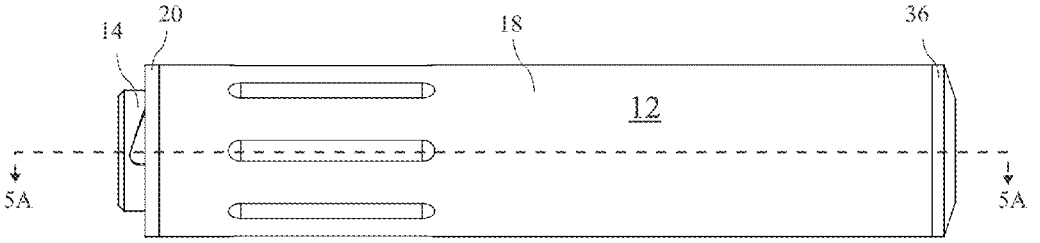
FIG. 5 is a side view of the suppressor fully attached to the muzzle adapter, according to the present invention.
Figure 5A:
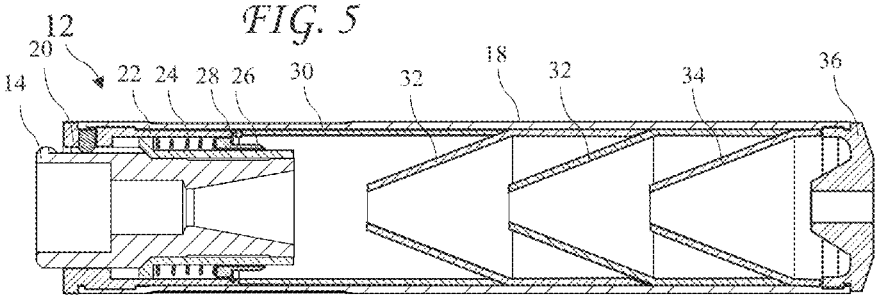
FIG. 5A is a cross-sectional view of the suppressor fully attached to the muzzle adapter, according to the present invention, taken along line 5A-5A of FIG. 5.

A detailed side view of the suppressor 12 partially attached to the muzzle adapter 14 is shown in FIG. 4, a cross-sectional view of the suppressor 12 taken along line 4A-4A of FIG. 4 is shown in FIG. 4A, a side view of the suppressor 12 fully attached to the muzzle adapter 14 is shown in FIG. 5 and a cross-sectional view of the suppressor 12 fully attached to the muzzle adapter 14 taken along line 5A-5A of FIG. 5 is shown in FIG. 5A. The suppressor 12 includes a suppressor tube 18, a removable rear cap 20 attached to the suppressor tube 18, a slider 22, a slider spring 24 biasing the slider 22 to the rear against the muzzle adapter 14, a spring retainer 26, a ring 28, a blast baffle spacer 30, two first baffles 32, and a second baffle 34, all serially residing inside the suppressor tube 18, and a removable front cap 36. The removable cap 20 and 36 are preferably threaded to engage the suppressor tube 18 to assemble the suppressor 12 and holding the blast baffle spacer 30, and baffles 32 and 34 in compression.

Figure 6:
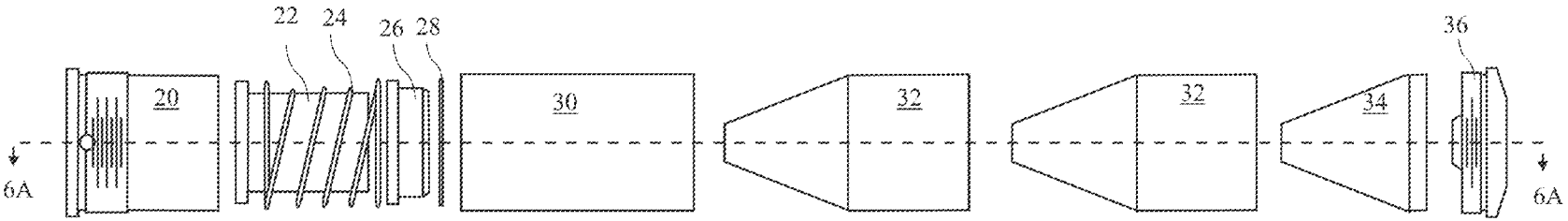
FIG. 6 is an exploded side view of the suppressor according to the present invention.

The elements of the suppressor 12 are shown separated in FIG. 6 and a cross-sectional view of the suppressor 12 taken along line 5A-5A of FIG. 5 is shown in FIG. 5A. Consecutive cooperating surfaces of the blast baffle spacer 30 and baffles 32 and 34 include an outside taper and a matching inside taper. When the suppressor is assembled, the end caps 20 and 36 place the blast baffle spacer 30 and baffle 32 and 34 in compression both centering each element and forming a seal between consecutive elements and between the elements and the suppressor tube 18. The blast baffle spacer 30 and baffle 32 and 34 are thus not welded to the suppressor tube 18.

The suppressor tube 18 has a length L1 and a diameter D1. The baffles 32 and 34 have interior cone angles A1 and corresponding approach angles A1' equal to 180 degrees minus A1. The front cap 36 has an interior cone angles A2 and corresponding approach angles A2' (see FIG. 16D) equal to 180 degrees minus A2. The mouths of the baffles 32 and 34 are separated by a separation S1, and the mouth of the baffle 34 is separated from the front cap 36 by a separation S2. The length L1 is preferably about 6.75 inches, the diameter D1 is preferably about 1.5 inches, the angle A1 is preferably between 16.3 degrees and 26.3 degrees, and more preferably about 21.3 degree, the angle A1' is preferably between 153.7 degrees and 163.7 degrees, and more preferably about 158.7 degrees, to sound waves, the angle A2 is preferably between 25.5 degrees and 35.5 degrees, and more preferably about 30.5 degree, the angle A2' is preferably between 144.5 degrees and 154.5 degrees, and more preferably about 149.5 degrees (see FIG. 16D), to sound waves, the separation S1 is preferably at least one inch and more preferably about 1.25 inches, and the separation S2 is preferably at least one inch and more preferably about 1.25 inches.

Figure 6A:
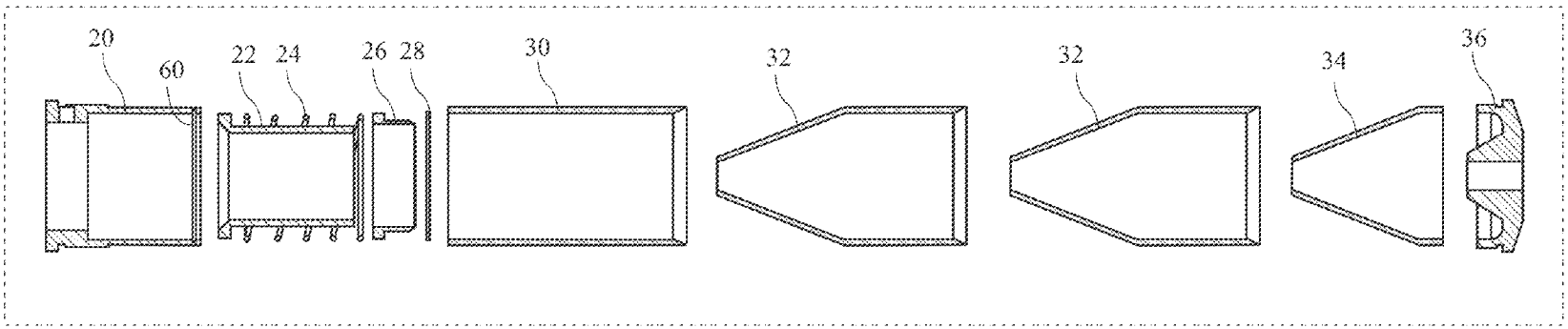
FIG. 6A is an exploded cross-sectional view of the suppressor according to the present invention, taken along line 6A-6A of FIG. 6.

An exploded side view of the suppressor 12 is shown in FIG. 6 and an exploded cross-section view of the suppressor 12 taken along line 6A-6A of FIG. 6 is shown in FIG. 6A. The individual elements of the suppressor 12 are described in detail in the following FIGS. 9-17D.

Figure 7:
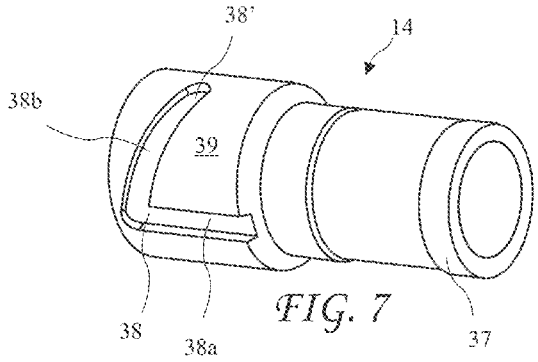
FIG. 7 is a perspective view of the muzzle adapter according to the present invention.
Figure 8B:
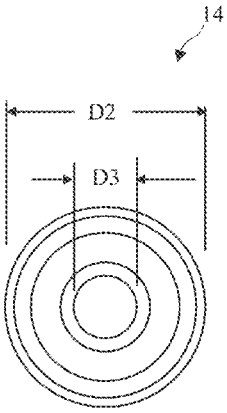
FIG. 8B is a rear view of the muzzle adapter according to the present invention.
Figure 8A:
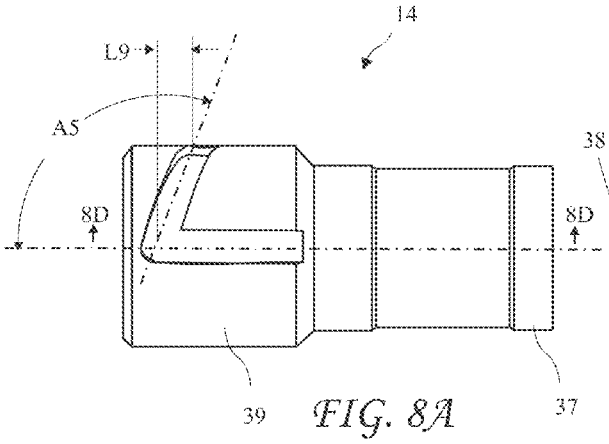
FIG. 8A is a side view of the muzzle adapter according to the present invention.
Figure 8C:
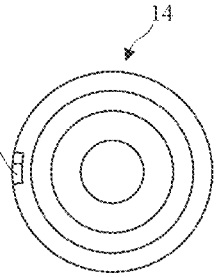
FIG. 8C is a front view of the muzzle adapter according to the present invention.
Figure 8D:
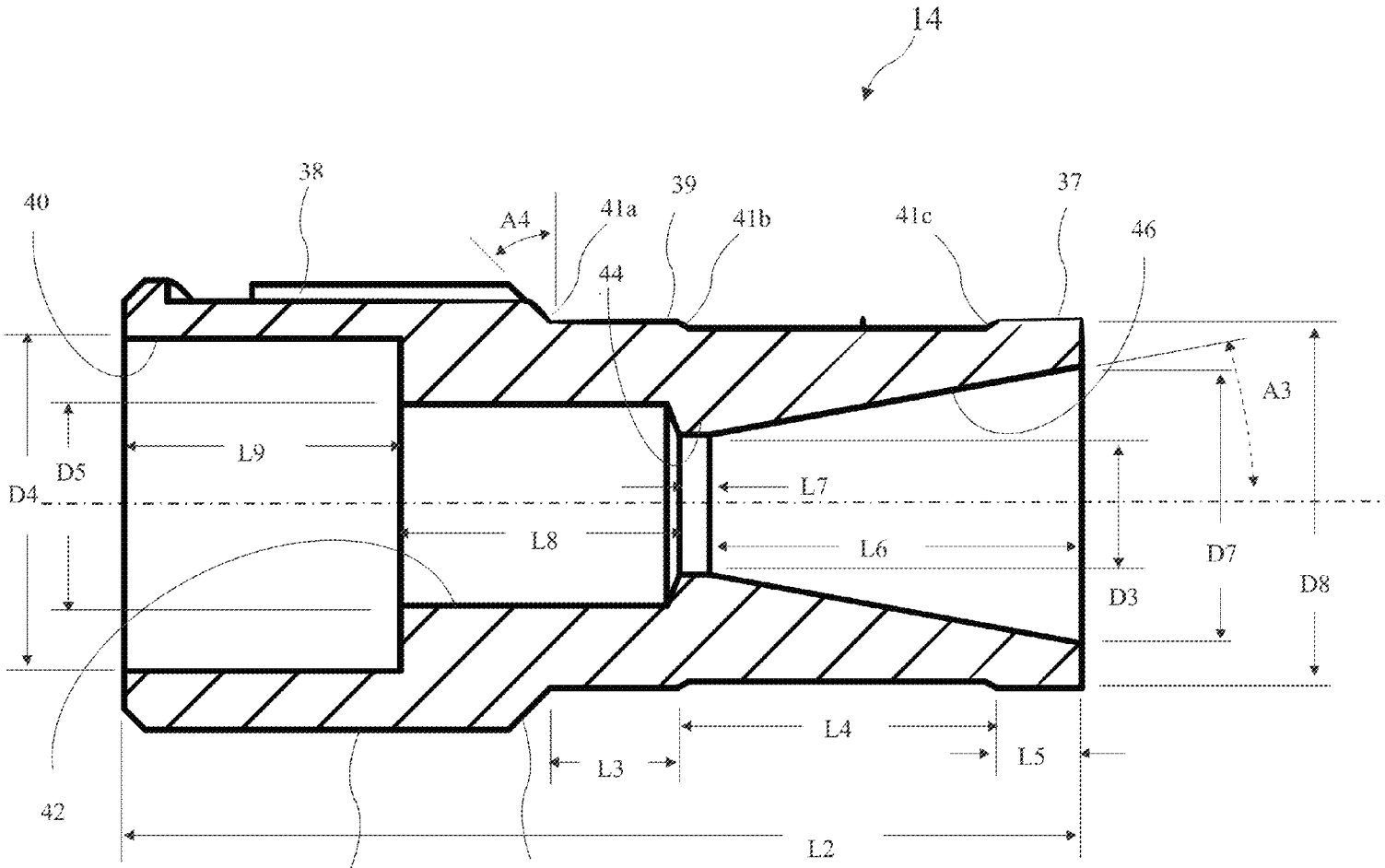
FIG. 8D is a cross-sectional view of the muzzle adapter according to the present invention taken along line 8D-8D of FIG. 8A.

A perspective view of the muzzle adapter 14 is shown in FIG. 7, a side view of the muzzle adapter 14 is shown in FIG. 8A, a rear view of the muzzle adapter 14 is shown in FIG. 8B, a front view of the muzzle adapter 14 is shown in FIG. 8C, and a cross-sectional view of the muzzle adapter 14 taken along line 8D-8D of FIG. 8A is shown in FIG. 8D. The muzzle adapter 14 includes lands 37 and 39 which slide into the slide 22 and rear cap 20 respectively. A slot 38 has a first leg 38*a* running parallel with the barrel 16 (see FIG. 1A) and a second leg 38*b* turned an angle A5 degrees and circling the land 39 about 90 degrees. The angle A5 is greater than 90 degrees and is preferably between 90 degrees and 110 degrees and more preferably about 106.8 degrees, the second leg 38*b* reaching forward a distant L9 of about 0.275 inches. The post 56 held by the rear cap 20 slides in the slot 38 and settles in the end of the second leg 38*b* to retain the suppressor on the rifle 10. The muzzle adapter 14 is preferably fixed on the barrel 16 with the first leg 38*a* at 12 o'clock. The muzzle adapter 14 has a outermost diameter D2 and an inner diameter D3. The diameter D2 is preferably about 1.055 inches and the diameter D3 is preferably about 0.328 inches.

The engagement of the post 56 with the slot 38 may be referred to as a past center engagement. As the suppressor 10 is pushed rearward over the muzzle adapter 14, the spring 24 (see FIGS. 4A, 5A, 6 and 6A) is compressed. As the suppressor 10 is rotated sliding slightly forward, the post 56 slides in the second leg 38*b* of the slot 38, the spring 24 relaxes pressing the post 56 against an end 38' of the second leg 38*b* of the slot 38, the spring 24 resisting movement of the suppressor on the muzzle adapter 14.

The muzzle adapter 14 has an overall length L2, and the lands 37 and 39 have lengths L5 and L3 respectively and are separated by a length L4 and have diameter D8. The lands 48, 37, and 39 are separated by ramps 41*a*, 41*b*, and 41*c* having slopes A4. The muzzle adapter 14 had a first interior step 40 which resides on the end of the barrel 16 (see FIG. 1A) and has an inside diameter D4 and a length L9, a second step 42 having an inside diameter D5 and a length L8, and a third step 44 having an inside diameter D9 and a length L7. The interior then opens in a conical region 46 having a conical angle A3 to a diameter D7 and has a length L6. The length L2 is preferably about 2.1 inches, the length L3 is preferably about 0.3 inches, the length L4 is preferably about 0.75 inches, the length L5 is preferably about 0.2 inches, the length L6 is preferably about 0.875 inches, the length L7 is preferably about 0.1 inches, the length L8 is preferably about 0.625 inches, and the length L9 is preferably about 0.5 inches. The land 48 is preferably about 0.85 inches in length.

The diameter D4 is preferably about 0.78 inches, the diameter D5 is preferably drilled to about 29/64 inches and tapped to one half by 28 threads, the diameter D7 is preferably about 0.65 inches, and the diameter D8 is preferably about 0.86 inches.

Figure 9:
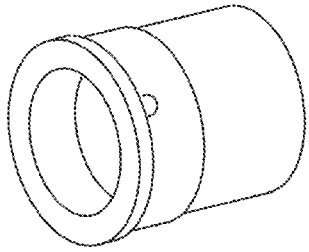
FIG. 9 is a perspective view of a rear cap according to the present invention.
Figure 10B:
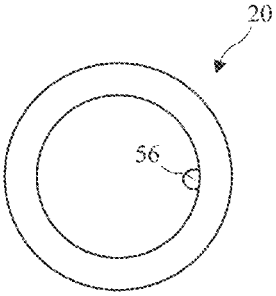
FIG. 10B is a rear view of the rear cap according to the present invention.
Figure 10A:
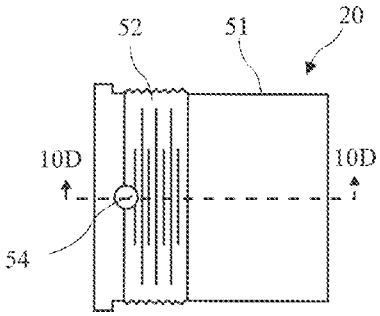
FIG. 10A is a side view of the rear cap according to the present invention.
Figure 10C:
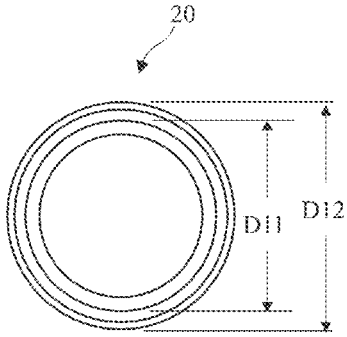
FIG. 10C is a front view of the rear cap according to the present invention.
Figure 10D:
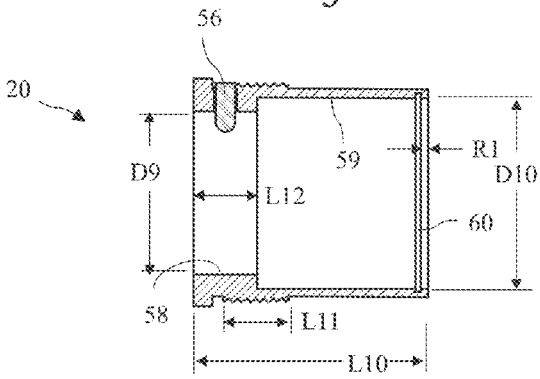
FIG. 10D is a cross-sectional view of the rear cap according to the present invention taken along line 10D-10D of FIG. 10A.

A perspective view of the rear cap 20 is shown in FIG. 9, a side view of the rear cap 20 is shown in FIG. 10A, a rear view of the rear cap 20 is shown in FIG. 10B, a front view of the rear cap 20 is shown in FIG. 10C, and a cross-sectional view of the rear cap 20 taken along line 10D-10D of FIG. 10A is shown in FIG. 10D. The rear cap 20 has a length L10, an outside diameter D12, a extended portion 51 having second outside diameter D11, a fourth step having an inside diameter D9, and an interior 59 having an inside diameter D10. A groove 60 is defined recessed into the interior 59 a recess R1. The rear cap 20 includes male threads 52 to attaching to the suppressor tube 18, the threads 52 having a major diameter of about 1.42 inches, a thread relief of about 0.065 inches and a thread length L11. The post 56 resides in a passage 54 in the rear cap 20.

The length L10 is preferably about 1.535 inches, the length L11 is preferably about 0.437 inches, the length L12 is preferably about 0.0.41 inches, the recess R1 is 0.050, the diameter D9 is preferably about 1.065 inches, the diameter D10 is preferably about 0.87 inches, the diameter D11 is preferably about 1.36 inches, and the diameter D12 is preferably about 1.5 inches.

Figure 11:
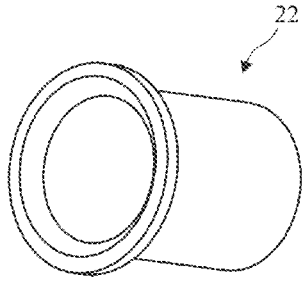
FIG. 11 is a perspective view of a slider according to the present invention.
Figure 12B:
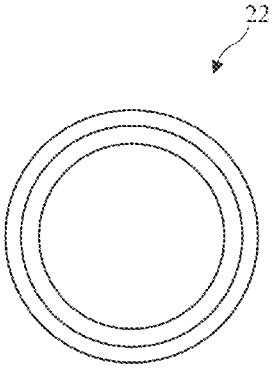
FIG. 12B is a rear view of the slider according to the present invention.
Figure 12A:
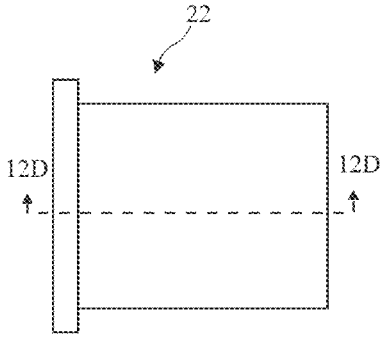
FIG. 12A is a side view of the slider according to the present invention.
Figure 12C:
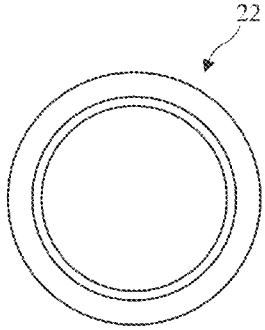
FIG. 12C is a front view of the slider according to the present invention.
Figure 12D:
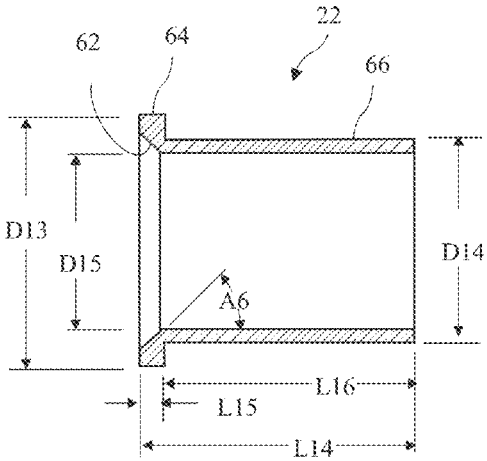
FIG. 12D is a cross-sectional view of the slider according to the present invention taken along line 12D-12D of FIG. 12A.

A perspective view of the slider 22 is shown in FIG. 11, a side view of the slider 22 is shown in FIG. 12A, a rear view of the slider 22 is shown in FIG. 12B, a front view of the slider 22 is shown in FIG. 12C, and a cross-sectional view of the slider 22 taken along line 12D-12D of FIG. 12A is shown in FIG. 12*d*. The slider 22 has an overall length L14, a third land length L15, an outside diameter D13 of the third land 64, a fourth land length L16 and outside diameter D14, and an inside diameter D15. The rear opening of the slider 22 has an inside taper 62 tapered at an angle A6.

The length L14 is preferably about 1.35 inches, the length L15 is preferably about 0.125 inches, the length L16 is preferably about 1.225 inches, the diameter D13 is preferably about 1.24 inches, the diameter D14 is preferably about one inch, the diameter D15 is preferably about 0.87 inches, and the angle A6 is preferably about 45 degrees.

Figure 13:
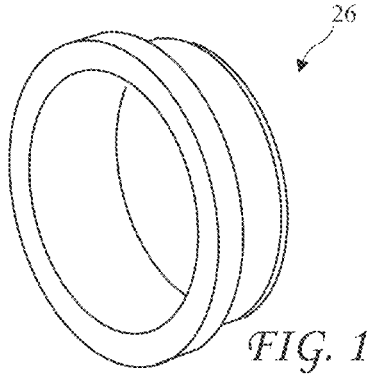
FIG. 13 is a perspective view of a spring stop according to the present invention.
Figure 14B:
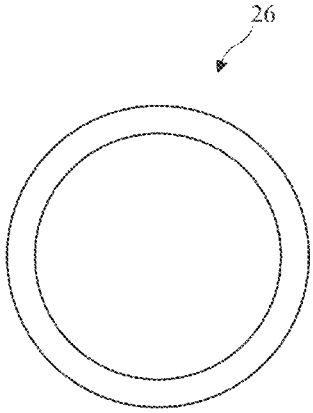
FIG. 14B is a rear view of the spring stop according to the present invention.
Figure 14A:
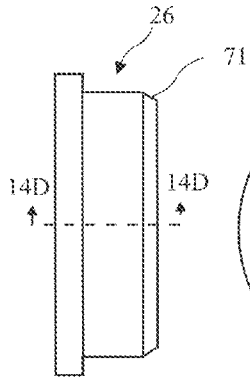
FIG. 14A is a side view of the spring stop according to the present invention.
Figure 14C:
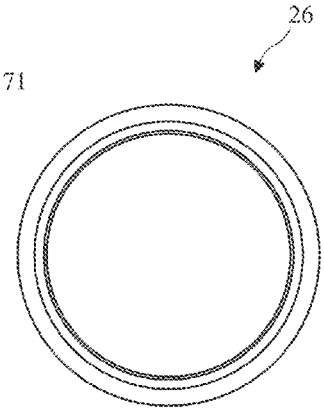
FIG. 14C is a front view of the spring stop according to the present invention.
Figure 14D:
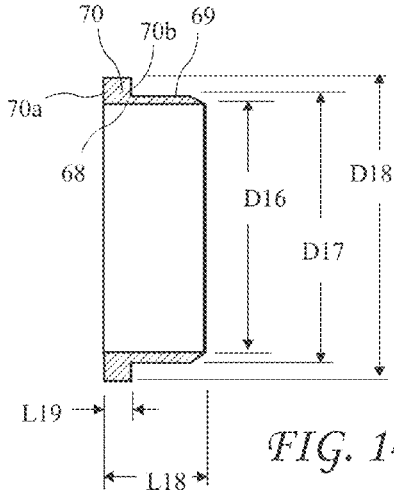
FIG. 14D is a cross-sectional view of the spring stop according to the present invention taken along line 14D-14D of FIG. 14A.

A perspective view of a spring stop 26 is shown in FIG. 13, a side view of the spring stop 26 is shown in FIG. 14A, a rear view of the spring stop 26 is shown in FIG. 14B, a front view of the spring stop 26 is shown in FIG. 14C, and a cross-sectional view of the spring stop 26 taken along line 14D-14D of FIG. 14A is shown in FIG. 14D. The spring stop 26 has an overall length L18 and an inside diameter D16. The spring stop 26 further includes a step 70 having an outside diameter D18 and a length L19, a rear face 70*a* stopping the slider spring 24 and a front face 70*b* residing against the clip 28 retaining the spring stop in the rear cap 20. The spring stop 26 further includes a sixth step 69 having a diameter D17 at the base of the front face 70*b* tapering to a sharp edge 71 for scraping carbon and other residue from the extended portion 51 of the slider 22 allowing easier disassembly of the suppressor 12.

The length L18 is preferably about 0.425 inches, the length L19 is preferably about 0.125 inches, the diameter D16 is preferably about 0.870 inches, the diameter D17 is preferably about 1.1 inches, and the diameter D18 is preferably about 1.24 inches.

Figures 15A, 15B, 15C:
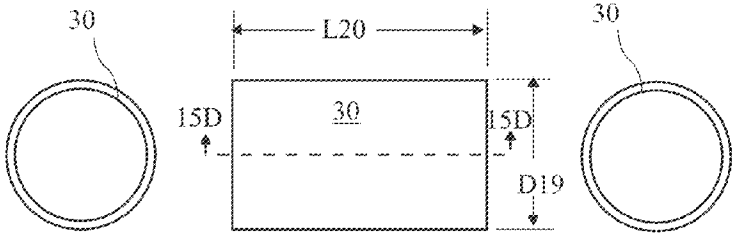
FIG. 15A is a side view of a blast baffle spacer according to the present invention.
FIG. 15B is a rear view of the blast baffle spacer according to the present invention.
FIG. 15C is a front view of the blast baffle spacer according to the present invention.
Figure 15D:
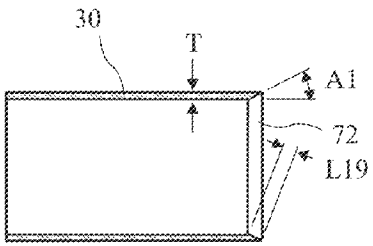
FIG. 15D is a cross-sectional view of the blast baffle spacer according to the present invention taken along line 15D-15D of FIG. 15A.

A side view of the blast baffle spacer 30 is shown in FIG. 15A, a rear view of the blast baffle spacer 30 is shown in FIG. 15B, a front view of the blast baffle spacer 30 is shown in FIG. 15C, and a cross-sectional view of the blast baffle spacer 30 taken along line 15D-15D of FIG. 15A is shown in FIG. 15D. The blast baffle spacer 30 has a length L20 and a diameter D17. The blast baffle spacer 30 has a wall thickness T and a forward end of the blast baffle spacer 30 has a tapered portion 72 tapered at the same conical angle A1 as the baffles 32 and 34. The tapered portion 72 has an overlap length 21 which overlaps the exterior of the adjacent baffle 32. The length L20 is preferably about 2.34 inches, the length L19 is preferably about 0.125 inches, and the diameter D19 is preferably about 1.36 inches. The thickness T is preferably between 0.045 inches and 0.08 inches, and is more preferably about 0.06 inches.

Figures 16A, 16B, 16C:
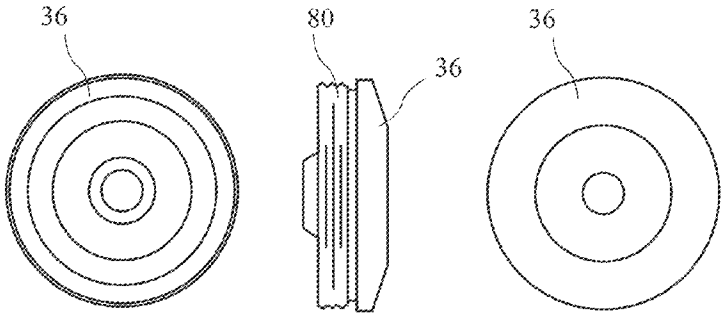
FIG. 16A is a side view of a front cap according to the present invention.
FIG. 16B is a rear view of the front cap according to the present invention.
FIG. 16C is a front view of the front cap according to the present invention.
Figure 16D:
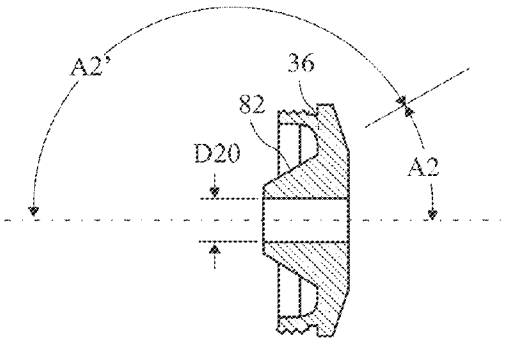
FIG. 16D is a cross-sectional view of the front cap according to the present invention taken along line 16D-16D of FIG. 16A.

A side view of the front cap 36 is shown in FIG. 16A, a rear view of the front cap 36 is shown in FIG. 16B, a front view of the front cap 36 is shown in FIG. 16C, and a cross-sectional view of the front cap 36 taken along line 16D-16D of FIG. 16A is shown in FIG. 16D. The front cap 36 includes male threads 37 for attaching to the suppressor tube 18. The threads 80 are preferably the same size threads as the threads 52 on the rear cap 20 (see FIG. 10A). The front cap 36 includes a conical interior face 82 defining a conical angle A2 and a second approach angle A2' with respect to sound waves, and an end cap bullet entry having a diameter D20. The conical angle A2 is preferably between 25.5 degrees and 35.5 degrees, and more preferably about 30.5 degree, the angle A1' is preferably between 144.5 degrees and 154.5 degrees, and more preferably about 149.5 degrees. The diameter D20 is preferably about 0.281 inches.

A side view of the first baffle 32 is shown in FIG. 17A, a rear view of the first baffle 32 is shown in FIG. 17B, a front view of the first baffle 32 is shown in FIG. 17C, and a cross-sectional view of the first baffle 32 taken along line 17D-17D of FIG. 17A is shown in FIG. 17D. The first baffle 32 has a mouth 84 with a bullet entry diameter D21 of at least 0.265 inches and has the same thickness T, outside diameter D19, and overlap portion 72 as the blast baffle spacer 30. A conical portion 32*a* of the baffle 32 has a length L21 and the straight portion 32*b* has a length L22. The length L21 is preferably about 1.25 inches and the length L22 is preferably about 1.25 inches.

A side view of the second baffle 34 is shown in FIG. 18A, a rear view of the second baffle 34 is shown in FIG. 18B, a front view of the second baffle 34 is shown in FIG. 18C, and a cross-sectional view of the second baffle 34 taken along line 18D-18D of FIG. 18A is shown in FIG. 18D. The second baffle 34 is preferably the same size as the first baffle 32, with an exception that while the conical portion 34*a* has the same length L21 as the conical portion 32*a*, the straight portion 34*b* is a length L23. The length L23 is preferably about 0.25 inches.

While the invention herein disclosed has been described by means of specific embodiments and applications thereof, numerous modifications and variations could be made thereto by those skilled in the art without departing from the scope of the invention set forth in the claims.

I claim:

1. A rifle suppressor comprising:

a suppressor tube;

at least three conical baffles residing sequentially inside the suppressor tube, the conical baffles presenting an approach angle between 153.7 degrees and 163.7 degrees to sound waves traveling through the suppressor.

2. The suppressor of claim 1, wherein mouths of the conical portions of the baffles are separated by at least one inch.

3. The suppressor of claim 2, wherein mouths of the conical portions of the baffles are separated by about 1.25 inch.

4. The suppressor of claim 1, wherein the approach angle is about 158.7 degrees.

5. The suppressor of claim 1, wherein the baffles are made from titanium.

6. The suppressor of claim 1, wherein the baffles are made from titanium having a thickness between 0.045 inches and 0.08 inches.

7. The suppressor of claim 6, wherein the baffles are made from titanium having a thickness of about 0.06 inches.

8. The suppressor of claim 6, wherein the suppressor includes a double wall between end caps.

9. The suppressor of claim 1, wherein the baffles are made from 6-4 titanium.

10. The suppressor of claim 1, wherein the baffles include tapered overlapping portions pressed together and expanding against the suppressor tube to fix positions of the baffles.

11. The suppressor of claim 10, wherein the tapered overlapping portions include outer portions of conical portions of the baffles.

12. The suppressor of claim 10, wherein the baffles are held in position solely by the expansion of the tapered overlapping portions against the suppressor tube.

13. The suppressor of claim 10, wherein the baffles are pressed together by threaded end caps, expanding the overlapping portions to position the baffles and lock the baffles in place.

14. The suppressor of claim 1, wherein the baffles have a bullet entry diameter D21 of at least 0.265 inches.

15. The suppressor of claim 14, wherein the baffles are pressed together between a rear end cap and a front end cap, and the front end cap has a end cap bullet entry diameter of at least 0.281 inches.

16. The suppressor of claim 1, wherein the baffles have a bullet entry diameter D21 of about 0.265 inches.

17. A rifle suppressor comprising:

a suppressor tube, a rear of the suppressor configured to attach to a rifle;

at least three conical baffles residing sequentially inside the suppressor tube, the conical baffles presenting an approach angle of 158.7 degrees to sound waves traveling through the suppressor, mouths of the conical portions of the baffles separated by at least one inch, and the baffles including tapered overlapping portions;

threaded rear and front end caps pressing the tapered overlapping portions together and expanding the tapered overlapping portions against the suppressor tube to fix positions of the baffles in the suppressor tube, the baffles held in position in the suppressor tube solely by the expansion of the tapered overlapping portions against the suppressor tube.

18. A rifle suppressor comprising:

a titanium suppressor tube having a wall thickness between 0.045 inches and 0.08 inches, a rear of the suppressor configured to attach to a rifle;

at least three titanium baffles residing sequentially inside the suppressor tube, each baffle comprising:

a wall thickness between 0.045 inches and 0.08 inches;

a conical portion narrowing towards the rear of the suppressor and providing an approach angle of about 158.7 degrees to sound waves traveling through the suppressor; and mouths having a bullet entry diameter (D21) of 0.265 inches;

the mouths of consecutive ones of the conical portions separated by about 1.25 inch and having;

tapered overlapping portions of consecutive ones of the baffles;

threaded rear and front end caps pressing the baffles together and expanding the tapered overlapping portions against the suppressor tube to align and fix positions of the baffles, the baffles held in position in the suppressor tube solely by the expansion of the tapered overlapping portions against the suppressor tube;

the front end cap has a end cap bullet entry diameter (D20) of 0.281 inches; and the rear end cap holding a cylindrical baffle spacer in compression between the rear end cap and a rear most of the baffles, the baffle spacer including a spacer tapered overlapping portion cooperating with the conical portion of the rear most of the baffles to expand under compression to align and fixedly position the overlapping portions against the suppressor tube.

* * * * *